US008769716B2

(12) United States Patent
Luscher

(10) Patent No.: US 8,769,716 B2
(45) Date of Patent: Jul. 8, 2014

(54) MOISTURE CONTROL GARMENT

(75) Inventor: Michael Luscher, Atlanta, GA (US)

(73) Assignee: Point 3 Basketball, LLC, Atlanta, GA (US)

( * ) Notice: Subject to any disclaimer, the term of this patent is extended or adjusted under 35 U.S.C. 154(b) by 218 days.

(21) Appl. No.: 13/511,436

(22) PCT Filed: Sep. 1, 2011

(86) PCT No.: PCT/US2011/050120

§ 371 (c)(1), (2), (4) Date: May 23, 2012

(87) PCT Pub. No.: WO2012/031059

PCT Pub. Date: Mar. 8, 2012

(65) Prior Publication Data

US 2012/0291177 A1 Nov. 22, 2012

Related U.S. Application Data

(60) Provisional application No. 61/378,993, filed on Sep. 1, 2010.

(51) Int. Cl.
*A41D 13/05* (2006.01)
*D06M 17/00* (2006.01)

(52) U.S. Cl.
CPC ..... *D06M 17/00* (2013.01); *A41D 2400/62* (2013.01)
USPC ..... 2/46; 2/69

(58) Field of Classification Search
CPC ..... A41D 1/00; A41D 1/06; A41D 1/08; A41D 13/0015; A41D 13/00; A41D 13/053; A41D 13/02; A41D 13/05; A41D 13/0525; A41D 2400/00; A41D 2400/62; A41D 20/00; A41D 31/00; A41D 31/02; A41D 31/0038; A41B 1/08; A63B 21/065; A63B 21/1419; A63B 71/12; A63B 71/1225; D10B 2401/021; D10B 2401/022; D10B 2501/00
USPC ..... 2/69, 79, 227, 228, 231, 336, 46
See application file for complete search history.

(56) References Cited

U.S. PATENT DOCUMENTS 3,045,245 A * 7/1962 Kohen ..... 2/227
3,174,156 A * 3/1965 Dale et al. ..... 2/115
4,768,236 A * 9/1988 Klob ..... 2/227

(Continued)

FOREIGN PATENT DOCUMENTS

WO 2006133094 12/2006
WO 2009017729 2/2009

OTHER PUBLICATIONS

International Search Report and the Written Opinion of the International Searching Authority dated Feb. 17, 2012 from the corresponding PCT/US2011/050120.

*Primary Examiner* — Khoa Huynh
*Assistant Examiner* — Andrew W Collins
(74) *Attorney, Agent, or Firm* — Katten Muchin Rosenman LLP

(57) ABSTRACT

A moisture control garment formed of a material that has moisture wicking (hydrophobic) properties joined to another material that has moisture absorbing (hydrophilic) properties. In certain embodiments, the moisture wicking and moisture absorbing materials are of similar thickness, have the same estimated shrinkage percentage, and the fibers of such materials are positioned in the same direction.

15 Claims, 3 Drawing Sheets

(56) References Cited

U.S. PATENT DOCUMENTS

| | | | | | |
|---|---|---|---|---|---|
| 5,014,360 | A * | 5/1991 | Smith et al. | 2/115 |
| 5,075,901 | A * | 12/1991 | Vollrath | 2/115 |
| 5,090,060 | A * | 2/1992 | Gates | 2/115 |
| 5,746,013 | A * | 5/1998 | Fay, Sr. | 36/3 R |
| 5,792,714 | A * | 8/1998 | Schindler et al. | 442/194 |
| 5,901,373 | A * | 5/1999 | Dicker | 2/69 |
| 7,737,056 | B2 * | 6/2010 | Chang | 442/5 |
| 2005/0208243 | A1 | 9/2005 | Chambers et al. | |
| 2005/0282455 | A1 * | 12/2005 | Foshee | 442/318 |
| 2008/0104739 | A1 * | 5/2008 | Kharazmi | 2/170 |
| 2009/0133446 | A1 * | 5/2009 | Burrow et al. | 66/176 |

* cited by examiner

MOISTURE CONTROL GARMENT

FIELD OF THE INVENTION

The present invention relates generally to garments/apparel and, in particular, to athletic apparel formed from both moisture wicking and moisture absorbing materials.

BACKGROUND OF THE INVENTION

Various sports or athletic activities cause participants to perspire in different ways. The participant's ability to more effectively manage this perspiration can often provide a competitive advantage during participation.

Athletes have, for decades, used varying fabrics to optimize performance. By way of specific example, a quarterback that uses a terrycloth towel hanging from his uniform waistband to keep his hands dry during play is generally provided greater accuracy when throwing the football. Tennis players wear headbands while playing to keep perspiration from getting on their face and into their eyes. Similarly, many basketball players wear wristbands to prevent moisture from reaching their hands and affecting ball control. These are examples of independent use of hydrophilic fabrics to absorb moisture from selected parts of the participant's body.

More recently, hydrophobic or moisture wicking fabrics have become somewhat commonplace in athletic activewear. These fabrics are typically defined as nonabsorbent materials that pull moisture away from the participant's skin, distributing the moisture evenly throughout the fabric and allowing the fabric to dry quickly. By wicking away the moisture, less moisture is absorbed by the fabric, generally keeping the garment lighter and in many cases, more comfortable for the participant.

SUMMARY OF THE INVENTION

Various embodiments of the present invention are to a moisture control garment comprising a first layer, positioned closest to a wearer, comprising hydrophobic moisture wicking material, and a second layer, joined to the first layer, comprising hydrophilic moisture absorbing material. In some embodiments, the first layer comprises the body of the garment and the second layer comprises one or more patches of fabric overlying the first layer.

In certain embodiments, the first layer comprises 100% polyester. In other embodiments, the first layer comprises between 80% and 99% polyester and 1% to 20% spandex. In certain embodiments of the present invention, the second layer comprises 100% polyester. In other embodiments, the second layer comprises 100% cotton. In still other embodiments, the second layer comprises between 80% and 99% cotton and 1% to 20% polyester. In other embodiments, the second layer comprises between 80% and 99% cotton and 1% to 20% nylon. In still other embodiments, the second layer comprises between 80% and 99% polyester and 1% to 20% polyamide. In further embodiments, the second layer comprises between 80% and 99% nylon and 1% to 20% polyamide.

In some embodiments, the first layer and the second layer are mechanically joined to each other. In other embodiments, the first layer and the second layer are joined at their seams. In still other embodiments, the layers are joined by adhesive bonding. In other embodiments, the first layer and the second layer are joined to each other by lamination. In other embodiments, the first layer and the second layer are joined to each other by sonic bonding.

In accordance with various embodiments of the present invention, the moisture control garment is treated to provide anti-microbial properties, anti-fungal properties, waterproofing or water resistance. In certain embodiments, the moisture control garment is treated using nanotechnology.

In certain embodiments of the present invention, the first layer and the second layer have a difference in thickness of less than 0.25 inches. In other embodiments, the fibers in the first layer and the second layer are positioned in the same direction. In further embodiments, the first layer and the second layer have the same estimated shrinkage percentage.

BRIEF DESCRIPTION OF DRAWINGS

For a fuller understanding of the present invention, reference should be made to the following detailed description taken in connection with the accompanying figures, in which.

DETAILED DESCRIPTION OF THE INVENTION

The present invention relates to apparel that can improve athletic performance and provide comfort for the wearer. The invention is centered on the concept of pairing one fabric that has moisture wicking properties (i.e., hydrophobic properties) with another fabric that has moisture absorbing properties (i.e., hydrophilic properties) in the same garment.

When used independently, hydrophilic fabrics will typically absorb their maximum level of moisture. When the fabric reaches its absorption capacity, the collected moisture soaks through the fabric and comes into contact with the wearer's skin, thereby defeating the garment's original purpose to absorb moisture from selected parts of the wearer's body. In addition, the excess moisture may be released from the garment when the garment is pressed and/or touched.

Conversely, when hydrophobic fabrics are used independently, the wearer is provided with no surface area upon which to wipe moisture from their extremities (hands, arms, face, etc.). The moisture wicking nature of these fabrics are by design, intended to pull moisture away rather than absorb.

Various embodiments of the present invention are directed to selecting a moisture wicking material having hydrophobic properties and a moisture absorbing material having hydrophilic properties and joining the materials together to form a garment for performance requirements or athletic application.

By implementing an embodiment of the present invention where a hydrophobic layer of fabric is inserted between the hydrophilic layer and the wearer's skin, the risk of moisture absorbing through the garment and coming into contact with the wearer's skin is almost completely eliminated. Further, the strategic integration of hydrophilic fabric into or on certain sections of a garment in accordance with embodiments of the present invention, allows the wearer to keep parts of their body moisture-free.

Figure 1:
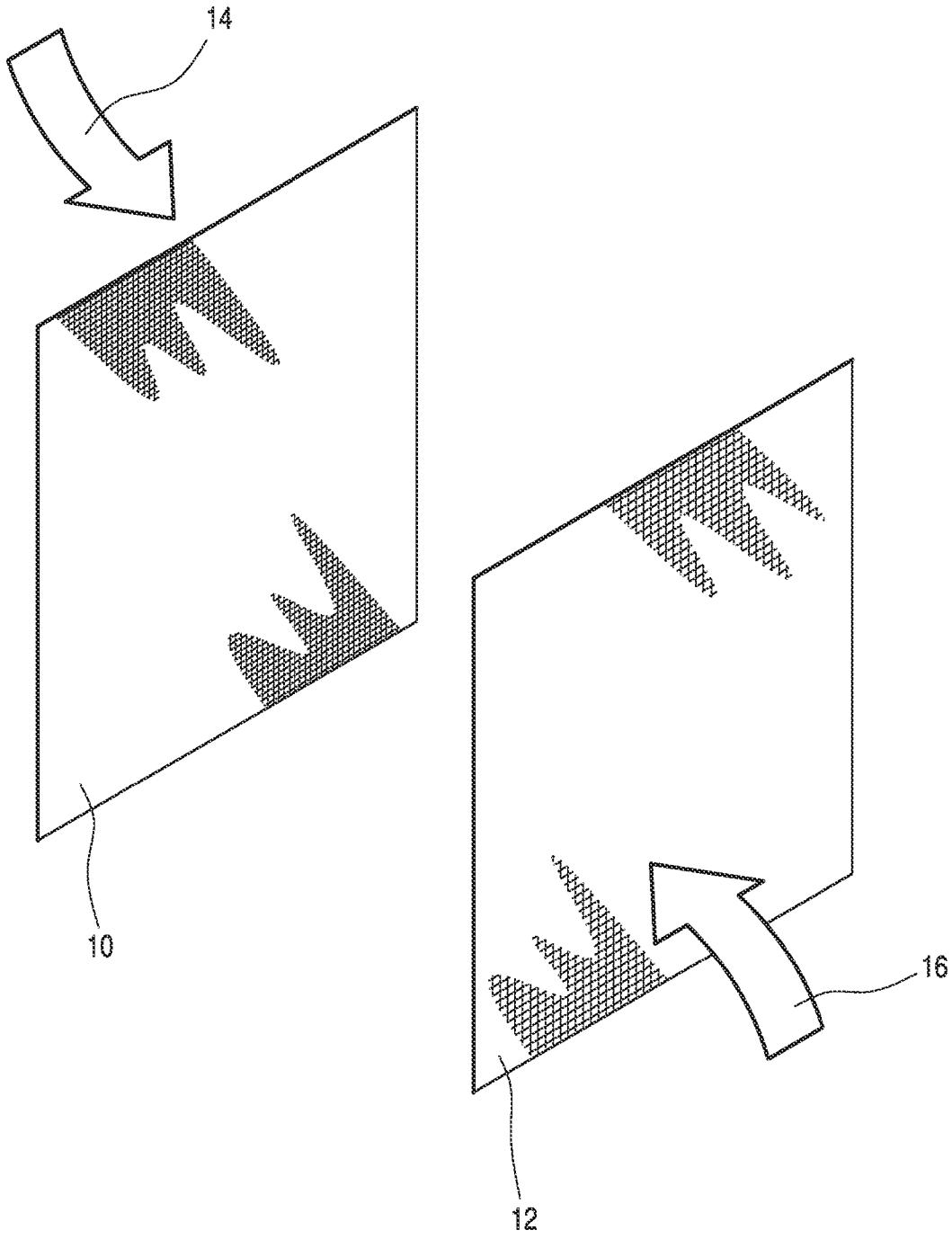
FIG. 1 generally illustrates the moisture wicking and moisture absorbing fabric layers forming apparel in accordance with an embodiment of the present invention.

FIG. 1 generally illustrates a layered structure of one embodiment of the present invention where an outer moisture absorbing (i.e., hydrophilic) layer 10 is positioned over a an inner moisture wicking (i.e., hydrophobic) layer 12. The moisture absorbing layer 10 absorbs moisture 14 thereby providing a dry surface area upon which the wearer may wipe moisture from their extremities. The moisture wicking layer 12 wicks moisture away 16 from the wearer's body, keeping the wearer dry and cool.

In FIG. 1, the moisture absorbing layer 10 is shown as an outer layer positioned over the inner moisture wicking layer 12. However, in other embodiments of the present invention, it may be advantageous to position the moisture wicking layer over the moisture absorbing layer. In still other embodiments, the moisture absorbing fabric and the moisture wicking fabric can be integrated into a single layer garment.

In certain embodiments, the present invention may have additional layers added on or between layers 10 and 12 to accommodate performance. Exemplary third layers include, but are not limited to hydrophilic material, hydrophobic material, waterproof material, breathable material, nonwoven material, foam, nonwoven and foam composite, spacer fabric, elastomeric composite, membrane, film or exterior shell fabric, depending on the performance requirements or athletic application.

The placement of each fabric type (wicking vs. absorbing) on or within an individual garment may be varied based upon the specific sport and/or activity in which the wearer is participating in order to effectively manage perspiration and maximize athletic performance.

Figure 2:
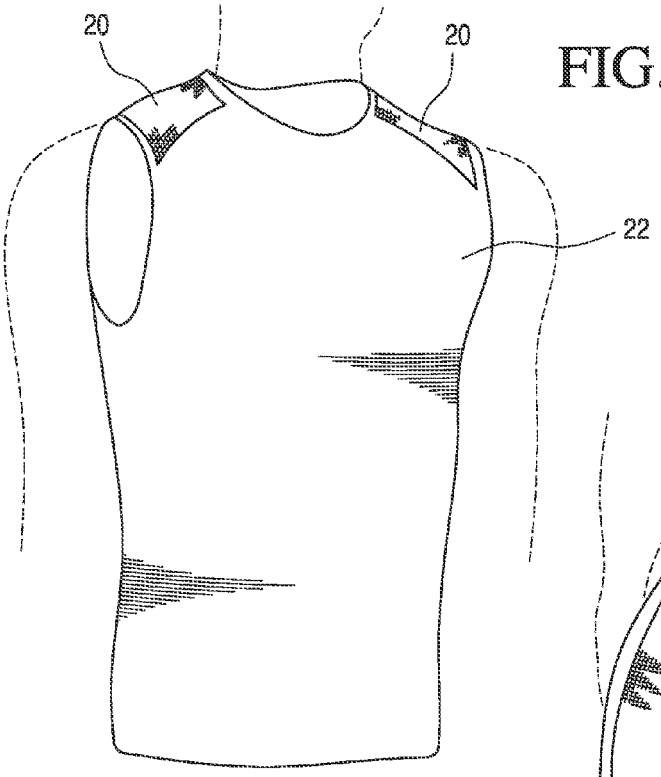
FIG. 2 depicts an embodiment of the present invention used in a shirt.

FIG. 2 depicts an embodiment of the present invention used in a shirt. As shown in FIG. 2, hydrophilic fabric patches 20 are positioned across the shoulders of a shirt formed of hydrophobic material 22 to facilitate the absorption of moisture, in particular, from the face and hands of the wearer. The hydrophobic material 22 forming the shirt wicks moisture away from the shirt wearer's body.

Figure 3:
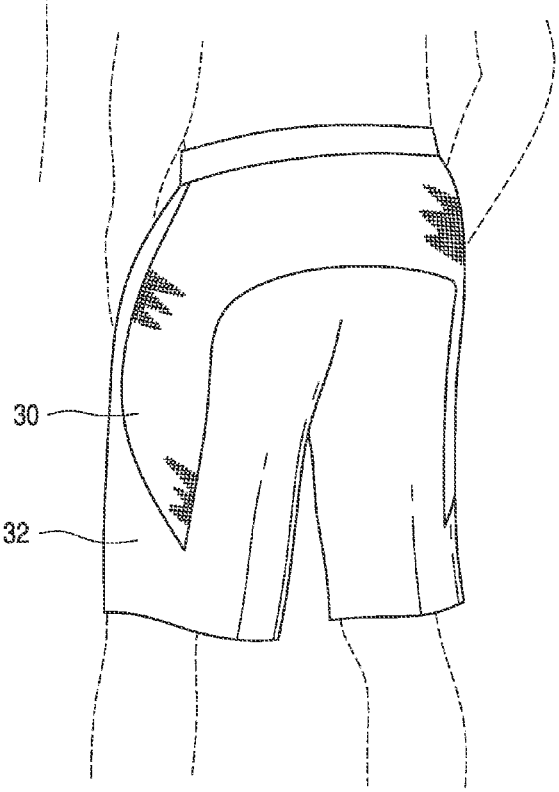
FIG. 3 depicts an embodiment of the present invention used in a pair of shorts.

FIG. 3 depicts an embodiment of the present invention used in a pair of shorts, where hydrophilic fabric 30 is positioned at the hips, legs and lower back overlying the garment body formed of hydrophobic material 32. The hydrophobic material 32 wicks moisture away from the wearer's body while the strategically positioned hydrophilic fabric 30 provides surface area upon which the wearer may wipe moisture from their extremities.

Figure 4:
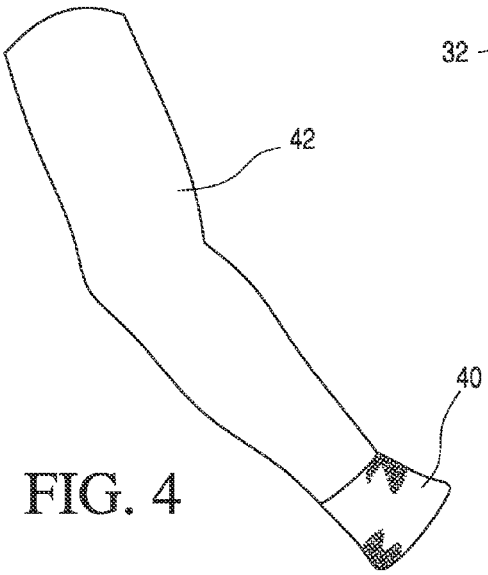
FIG. 4 depicts an embodiment of the present invention used in a compression sleeve.

FIG. 4 depicts an embodiment used in a compression sleeve. As shown in FIG. 4, a hydrophilic band 40 is positioned around the wrist for absorbing moisture from the wearer's face and hands. The sleeve 42 is formed of hydrophobic material, which serves to wick moisture away from the length of the wearer's arm.

The joining together of the moisture wicking material and the moisture absorbing material may be varied based performance requirements or athletic application. In accordance with various embodiments of the invention, the hydrophilic layer and the hydrophobic layer are joined to each other. In some embodiments, the hydrophilic and hydrophobic fabrics paired together in the same garment are joined at one or more seams where each fabric has been cut according to a specific pattern used in making the garment. In other embodiments, such as where a hydrophilic fabric patch or panel is placed directly on top of a continuous piece of hydrophobic fabric, the fabrics may not be joined at a seam. Rather, in some embodiments, the hydrophilic patch or panel may be joined directly on top of the hydrophobic fabric. In certain embodiments, the entire portion of one side of the hydrophilic patch or panel may be joined to the hydrophobic fabric, while in other embodiments, only a portion of the hydrophilic patch or panel may be joined to the hydrophobic fabric. In other embodiments, the hydrophilic and hydrophobic fabrics are joined both at a seam and directly together.

In certain embodiments, the fabrics are mechanically joined (e.g., sewn or stitched together). A variety of stitch methods (e.g., flatlock, surge, double seam) may be utilized based on the method best suited to pair the specific fabrics and the intended use of the garment.

Alternatively, adhesive may be used to join the hydrophilic fabric to the hydrophobic fabric. In these embodiments, the type of adhesive utilized must be compatible with the overall garment construction as well as the garment's care instructions. Exempleary adhesives that may be used in this process include, but are not limited to the DESMOCOLL®, DESMOMELT®, DISPERCOLL®, DESMODUR® and BAYHYDUR® product lines from Bayer MaterialScience AG, a variety of seam sealing tapes and heat transfer adhesives that allow for the permanent bonding of two fabrics without the use of any stitching. The bonding is instead effectuated using, for example, heat, lamination or sonic pressure.

Additional methods of bonding the hydrophilic layer and the hydrophobic layer include welding or a combination of any of the bonding techniques referenced herein. In certain embodiments, the use of an adhesive is paired with sewing the hydrophilic panel to the hydrophobic fabric.

The moisture absorbing and moisture wicking layered system embodied in the present invention has been optimized so that when the layers are bonded together or otherwise paired, the garment fits the wearer properly and maintains that fit after multiple washings/launderings. This is an especially challenging process in light of the varying properties and behavior of most hydrophobic vs. hydrophilic fabrics.

When two different fabrics are joined or combined together in one garment, it is critical that the fabrics paired together are compatible. Further, once it is determined that the fabrics are compatible, the fabrics need to be combined together in a way so as to maximize effectiveness and durability. To ensure quality and durability, the following characteristics have been addressed in various embodiments of the present invention:

Shrinkage Levels

Different fabrics shrink in distinct ways and in distinct proportions when they are washed. Typically, fabric mills will test the percentage levels that their fabrics shrink after laundering, and will include those shrinkage levels when selling fabric to customers. In embodiments of the present invention, when pairing the moisture wicking (i.e., hydrophobic properties) fabric and the moisture absorbing (i.e., hydrophilic) fabric together, the shrinkage levels, both "east/west" and "north/south", are determined to be compatible so that when the two fabrics are washed together in the same garment, there is no warping around the seam or other point of attachment. Preferably, the hydrophobic fabric and the hydrophilic fabric paired together will have the same estimated shrinkage percentage. If there is more than a 1 to 2% difference in shrinkage, the one or more of the fabrics should be preshrunk before joining the two fabrics together. In addition, a garment wash test is typically performed on the finished garment at a testing lab to confirm compatibility.

Matching the Knap

As used herein, the term "matching the knap" refers to the process of ensuring that the fibers in both the hydrophobic fabric and the hydrophilic fabric are positioned in the same direction. If the "knap" is not matched between the two fabrics used in one garment, potential problems may occur. In particular, the garment runs the risk of warping after laundering, if the fabrics used have any elastic properties (i.e., where spandex, LYCRA®, elastane and the like have been incorporated in one or more of the fabrics) the level of elasticity may vary depending upon the direction of the fibers and the feel of the garment may be rough to the touch.

Figure 5A:
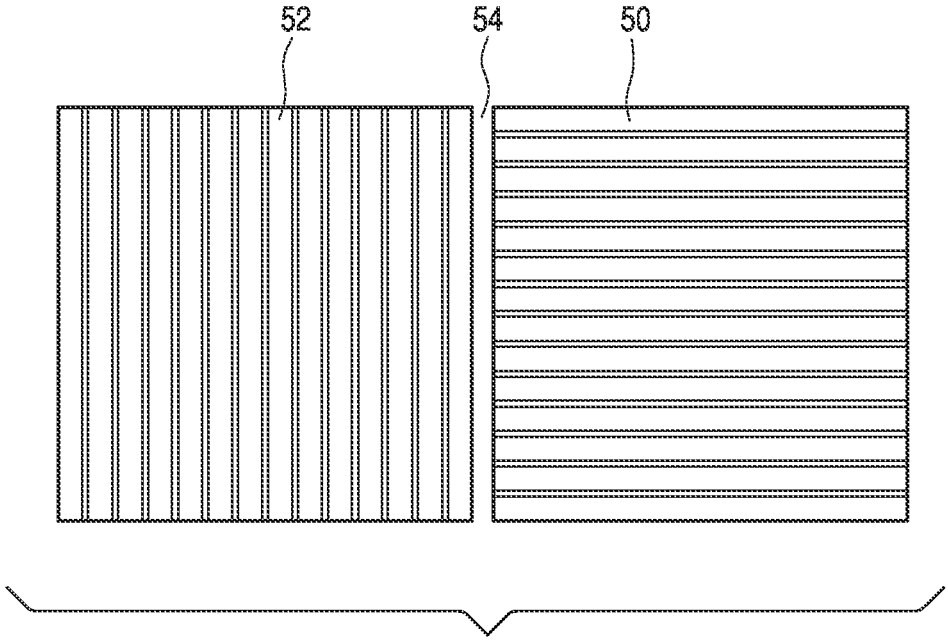
FIGS. 5A-B illustrate "matching the knap" of the moisture wicking and moisture absorbing fabric layers in accordance with an embodiment of the present invention.
Figure 5B:
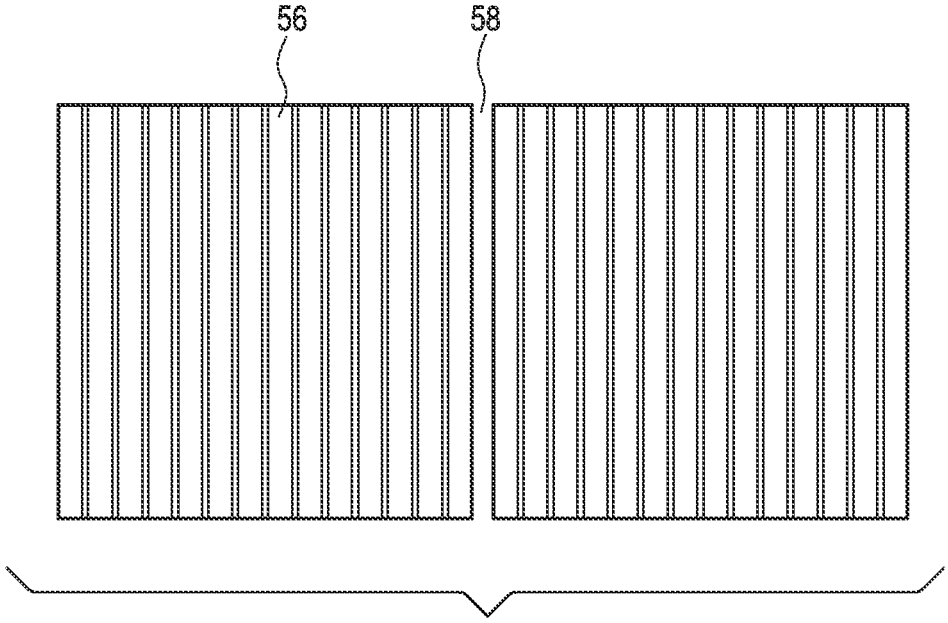

FIG. 5A depicts two fabrics paired together where the knap is not matched. In FIG. 5A, the horizontal lines 50 and vertical lines 52 in each square represent the direction that the fibers in each fabric are facing. The white space 54 between these two squares represents the seam that joins the two fabrics. Fibers must be positioned in the same direction, as shown in FIG. 5B, to provide for a near seamless feel. If one were to move their hand from left to right across a garment having the orientation shown in FIG. 5A, a rough patch would be detected when moving across the first square (with vertical lines 52), whereas it would be far smoother when moving across the second square (with horizontal lines 50) as they would be moving their hand in same direction that the fibers are facing in the garment. The fiber alignment as shown in FIG. 5A would also create a problem if the fabric had elastic properties, even if the fabric on either side of the seam 54 were identical.

FIG. 5B illustrates two fabrics paired together where the knap is matched. As shown in FIG. 5B, the fibers 56 are all facing one direction, regardless of seam 58 placement. The entire garment would be smooth to the touch when moving one's hand in the same direction as the fibers 56.

Care Instructions

Recommended care instructions may vary based on type of fabric. In accordance with various embodiments of the present invention, the recommended care instructions for both the moisture wicking fabric and the moisture absorbing fabric are examined when pairing the fabrics together in one garment to ensure that the recommended care instructions for both fabrics will effectively clean the entire garment without affecting its wearability. For example, if one fabric's care instructions recommends "Machine Wash Cold, Tumble Dry Low" and the other recommends "Machine Wash Cold, Line Dry Only", the garment runs the risk of becoming warped when laundered. Further, each garment can only have one set of care instructions, the instructions must be consistent between the two fabrics.

Fabric Weight and Thickness

The moisture wicking and moisture absorbing fabrics paired together in certain embodiments of the present invention are of comparable weight and thickness. If weight and thickness are not considered, certain sections of the garment may outweigh others, thereby adversely affecting the overall fit of the garment or pulling the garment in a manner not conducive to athletic performance By way of example, if the hydrophilic fabric used in a garment had a thickness of 0.25 inches and the hydrophobic fabric a thickness of 0.625 inches, the hydrophilic fabric would likely retain more moisture (and with that moisture, more weight) than the hydrophobic fabric could adequately handle. The result would be a garment where the added weight of the hydrophilic fabric would pull the hydrophobic fabric and distort the fit of the garment. In preferred embodiments of the present invention, the moisture wicking and moisture absorbing fabrics have a difference in thickness of less than 0.25 inches.

Color Blocking

Certain fabrics of particular colors cannot be paired with other fabrics of different colors in the same garment (a manufacturing term known as "color blocking") because the dye used in some fabrics can run onto the dye of the other fabric. In preferred embodiments of the present invention, the color selected for use in one fabric will not run onto any other fabric on the garment. By way of example, if a 100% polyester fabric in red is paired in the same garment with a 100% polyester fabric in white, there is a strong likelihood that when the garment is washed, the white section of the garment will absorb some of the red dye and turn a shade of pink. Such a selection will not be made in embodiments of the present invention.

The specific fabrics used in apparel construction are of significant importance to the present invention. Exemplary wicking (i.e., hydrophobic) fabrics include, but are not limited to 100% polyester, polyester/spandex, polyester/LYCRA® and polyester/elastane compositions that maintain a percentage ratio between 80% polyester/20% spandex, LYCRA® and elastane and 99% polyester/1% spandex, LYCRA® and elastane, 100% nylon, nylon/spandex, nylon/LYCRA® and nylon/elastane compositions that maintain a percentage ratio between 80% nylon/20% spandex, LYCRA® and elastane and 99% nylon/1% spandex, LYCRA® and elastane.

Exemplary absorbing (i.e., hydrophilic) fabrics include, but are not limited to 100% cotton, 100% looped terry cotton, 100% velour, 100% modal cotton, 100% bamboo, cotton/polyester compositions that maintain a percentage ratio between 80% cotton/20% polyester and 99% cotton/1% polyester, cotton/nylon compositions that maintain a percentage ratio between 80% cotton/20% nylon and 99% cotton/1% nylon, polyester/polyamide compositions that maintain a percentage ratio between 80% polyester/20% polyamide and 99% polyester/1% polyamide, and nylon/polyamide compositions that maintain a percentage ratio between 80% nylon/20% polyamide and 99% nylon/1% polyamide. In preferred embodiments of the present invention, the hydrophilic fabric is 100% polyester.

Independent of the composition of the fabrics used in the present invention, the fabrics may also have certain benefits specifically engineered for athletic activewear. Some such benefits could derive from the natural composition of the fiber (e.g., the natural anti-microbial nature of bamboo). In other embodiments, the benefits are derived from treatments integrated directly into the fiber (e.g., utilizing nanotechnology) or based on certain applications after knitting. In any event, the engineered design to enhance performance and will typically include one or all of the following benefits: anti-microbial/anti-fungal, moisture wicking, water proof/water resistance and moisture absorbing properties.

Although the foregoing refers to particular embodiments, it will be understood that the present invention is not so limited. It will occur to those of ordinary skill in the art that various modifications may be made to the disclosed embodiments and that such modifications are intended to be within the scope of the present invention.

I claim:

1. An athletic garment for covering portions of a wearer's body formed from a first material having moisture wicking properties, one side of said first material is positioned toward the wearer to wick moisture away from the body parts of the wearer in the portions covered by the first material and another side of said first material faces the outside of the garment to release such moisture to the environment, and sections of a second material having moisture absorbing properties which second material is secured at only limited selective locations on the garment leaving the substantial majority of the garment having only the first material, said selective locations being strategically accessible to other parts of the wearer's body not being covered by the garment, such second material providing a surface area to absorb moisture from such other parts of the wearer's body when such other parts are wiped onto said sections of the second material, said first and second materials having structural characteristics including thickness, size and fabric weight to be compatible with each other to maximize the effectiveness of the first and second materials whereby the first material can efficiently wick moisture from the body parts of the wearer covered by the first material and the second material can efficiently absorb moisture from the body parts not covered by the garment; wherein the difference in thickness between the thickness of the sections of the second material and the thickness of the first material is 0.25 inches or less.

2. The athletic garment as in claim 1, wherein such locations are wherever the wearer may need to absorb moisture from their body extremities, such as wearer's hands, arms or face.

3. The athletic garment as in claim 1, wherein said sections are secured to selected parts of the first material.

4. The athletic garment as in claim 1, wherein said sections of said second material overly said first material.

5. The athletic garment as in claim 1 wherein said first material is hydrophobic.

6. The athletic garment as in claim 1 wherein said sections of said second material are secured to the underlying first material only at selected places to thereby maintain a layer of air between the sections of the second material and the underlying first material to permit the second material to release some of its moisture to said layer of air, before any remaining moisture is wicked away from the overlying second material by the underlying first material.

7. The athletic garment as in claim 1 wherein said sections are secured by one of bonding, lamination or adhesive.

8. The athletic garment as in claim 1, wherein said garment is a pair of shorts, and the sections of said second material are located over at least one of the hips, legs and lower back to be accessible to the wearer's hands.

9. The athletic garment as in claim 1, wherein the moisture wicking material and the moisture absorbing material have a similar estimated shrinkage percentage.

10. The athletic garment of claim 1, wherein the fibers of the first material and the fibers of the second material are positioned within the garment in the same direction.

11. The athletic garment of claim 1, wherein the first material is formed substantially of polyester.

12. The athletic garment as in claim 1, wherein said garment is a shirt and the sections of the second material are located over the shoulder area.

13. The athletic garment as in claim 1, wherein said garment is a compression sleeve, and the sections of the second material are located over the wrist areas.

14. The athletic garment as in claim 1, wherein said structural characteristics of said first and second materials, permit said first material to also wick away moisture from the second material secured thereto and originating from body parts not covered by the garment, and permit said second material to absorb moisture form the first material secured thereto and originating from the body parts covered by the first material.

15. The athletic garment as in claim 1, wherein said second material is attached on all sides to said first material so as to be available to the other parts of the body.

* * * * *